US010558160B2

(12) United States Patent
Nishida

(10) Patent No.: US 10,558,160 B2
(45) Date of Patent: Feb. 11, 2020

(54) CLEANING DEVICE AND IMAGE FORMING APPARATUS

(71) Applicant: Konica Minolta, Inc., Chiyoda-ku, Tokyo (JP)

(72) Inventor: Satoshi Nishida, Saitama (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/272,433

(22) Filed: Feb. 11, 2019

(65) Prior Publication Data

US 2019/0265634 A1 Aug. 29, 2019

(30) Foreign Application Priority Data

Feb. 28, 2018 (JP) ..... 2018-035266

(51) Int. Cl.
*G03G 21/00* (2006.01)
*G03G 15/16* (2006.01)

(52) U.S. Cl.
CPC ..... *G03G 21/0017* (2013.01); *G03G 15/161* (2013.01); *G03G 15/168* (2013.01); *G03G 21/0058* (2013.01); *G03G 21/0076* (2013.01); *G03G 2215/1652* (2013.01); *G03G 2215/1657* (2013.01); *G03G 2215/1661* (2013.01)

(58) Field of Classification Search
CPC .. G03G 15/161; G03G 15/168; G03G 21/007; G03G 21/0011; G03G 21/0017; G03G 21/0076; G03G 2221/001; G03G 2221/0015; G03G 2221/0047; G03G 2221/0068; G03G 2221/0089; G03G 2215/1647; G03G 2215/1661
See application file for complete search history.

(56) References Cited

U.S. PATENT DOCUMENTS

2008/0304856 A1* 12/2008 Takahashi ..... G03G 15/161 399/101
2009/0185842 A1* 7/2009 Hatori ..... G03G 21/0011 399/346
2014/0178090 A1* 6/2014 Nakamura ..... G03G 15/161 399/71
2018/0113402 A1* 4/2018 Seko ..... G03G 15/161

FOREIGN PATENT DOCUMENTS

JP 2006251751 A 9/2006

* cited by examiner

*Primary Examiner* — Thomas S Giampaolo, II
(74) *Attorney, Agent, or Firm* — Buchanan Ingersoll & Rooney PC

(57) ABSTRACT

A cleaning device cleans a surface of a toner carrier carrying a toner, and the cleaning device includes: a first blade in contact with the surface of the toner carrier; a second blade made of a material harder than a material of the first blade and in contact with the surface of the toner carrier; and a lubricant applicator that applies a lubricant to the surface of the toner carrier, wherein the first blade, the second blade and the lubricant applicator are arranged in this order from an upstream side in a moving direction of the toner carrier based on a transfer position of the toner.

12 Claims, 4 Drawing Sheets

CLEANING DEVICE AND IMAGE FORMING APPARATUS

The entire disclosure of Japanese patent Application No. 2018-035266, filed on Feb. 28, 2018, is incorporated herein by reference in its entirety.

BACKGROUND

Technological Field

The present invention relates to a cleaning device and an image forming apparatus.

Description of the Related Art

In recent years, for electrophotographic image forming apparatuses, there has been a demand for making the size of toner particles smaller from the viewpoint of high image quality. For example, toner particles produced by a polymerization method such as an emulsion polymerization method or a suspension polymerization method are used.

Here, as a method for removing a residual toner after transfer on an image carrier such as a photoreceptor, there is a method of scraping off the toner particles by a cleaning blade made of urethane rubber or the like brought into contact with the image carrier in a counter direction. However, as the diameters of the toner particles are reduced, the adhesion force between the toner particles and the image carrier increases, so that it becomes difficult to remove residual toner on the image carrier. In particular, as for a cleaning blade having been used for a long period of time, the tip in contact with the image carrier wears, and the scraping force decreases, so that a cleaning failure namely so-called "slipping through" in which the toner passes through the blade occurs and thus removing residual toner on the image carrier becomes difficult.

In view of the above, JP 2006-251751 A discloses a technique of providing a lubricant application device disposed on the downstream side of the cleaning blade for applying a lubricant on the surface of the photoreceptor and further disposing a blade for leveling on the downstream side of the device. In the disclosed technique, the lubricant is uniformly applied to the surface of the photoreceptor, thereby improving the releasability of the surface of the photoreceptor and preventing cleaning failure.

However, as the cleaning blade is used, the edge wears. With the worn edge, removing the external additive added to the toner (separated external additive) is difficult. In addition, slipping-through of toner can also occur although the slipping-through is in such a degree that the situation cannot be visually recognized in the image.

In such a situation, the toner and the external additive that have slipped through the cleaning blade adhere to the application brush of the lubricant application device. Under such circumstances, the performance of the lubricant application device deteriorates and the lubricant cannot be applied evenly to the photoreceptor or the like, so that in the portion where the lubricant is not applied, the toner and the external additive adhere and stick to the photoreceptor or the like, eventually causing image defects.

SUMMARY

The present invention has been made in view of the above circumstances, and an object thereof is to provide a cleaning device with a long duration of operation until the occurrence of an image defect and with improved durability.

To achieve the abovementioned object, according to an aspect of the present invention, there is provided a cleaning device for cleaning a surface of a toner carrier carrying a toner, and the cleaning device reflecting one aspect of the present invention comprises: a first blade in contact with the surface of the toner carrier; a second blade made of a material harder than a material of the first blade and in contact with the surface of the toner carrier; and a lubricant applicator that applies a lubricant to the surface of the toner carrier, wherein the first blade, the second blade and the lubricant applicator are arranged in this order from an upstream side in a moving direction of the toner carrier based on a transfer position of the toner.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
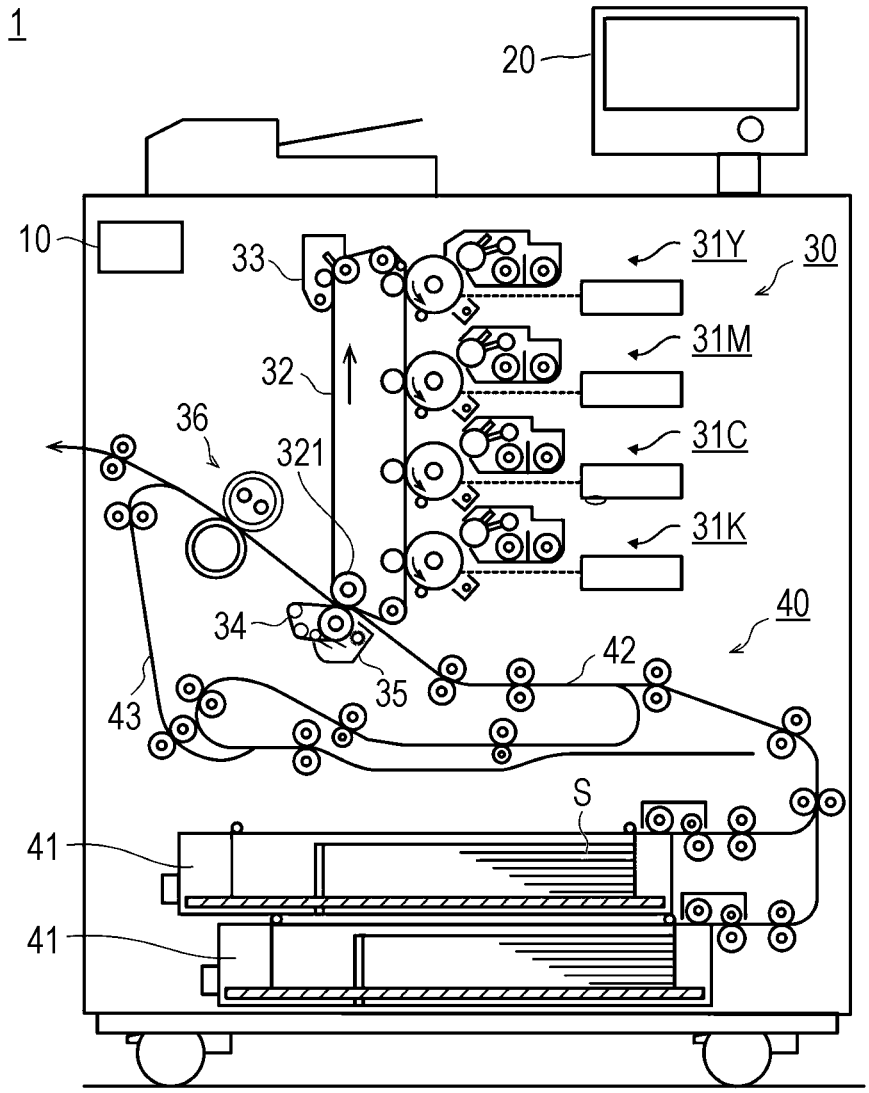
FIG. 1 is a diagram showing a schematic configuration of an image forming apparatus according to an embodiment of the present embodiment.

Hereinafter, one or more embodiments of the present invention will be described with reference to the drawings. However, the scope of the invention is not limited to the disclosed embodiments. In the description of the drawings, the same elements are denoted by the same reference numerals, and duplicate descriptions are omitted. Also, the dimensional ratios of the drawings are exaggerated for convenience of description and may differ from the actual ratio in some cases.

FIG. 1 is a diagram showing a schematic configuration of an image forming apparatus according to the present embodiment. As shown in FIG. 1, the image forming apparatus 1 includes a control unit 10, an operation panel 20, an image forming section 30, and a sheet feeding conveyance section 40.

The control unit 10 includes a central processing unit (CPU) and a memory, and executes various control of the entire image forming apparatus 1 by the CPU executing a control program stored in a memory.

The operation panel 20 includes a touch panel, ten-key pad, start button, stop button, and the like, and is used for inputting various settings related to the apparatus, display of the state of the apparatus, and input of various instructions.

Image Forming Section 30

The image forming section 30 includes an image former 31, an intermediate transfer belt 32, a cleaning device 33 for the intermediate transfer belt 32, a secondary transfer section 34, a cleaning device 35 for the secondary transfer section 34, and a fixing device 36.

The image former 31 has configurations corresponding to the respective basic colors of yellow (Y), magenta (M), cyan (C), and black (K). The intermediate transfer belt 32 moves in the clockwise direction in the drawing (see the arrow). As the order of arrangement of the image formers 31 of Y, M, C and K, the image former 31 for Y is at the most upstream position and the image formers 31 for M, C, and K are at the second to fourth positions respectively.

Each of the image formers 31 includes a photoreceptor drum, a charging electrode, an exposure unit, a developing device, a cleaning unit, a primary transfer section, and the like. The developing device contains two components of developer. Each image former 31 has the same configuration except for the color of the toner of the developer stored in the developing device.

As described above, the developing device of each image former 31 contains two-component developer composed of toner of small particle sizes of different colors of yellow, magenta, cyan and black, respectively and carriers. The two-component developer is composed of a carrier in which ferrite is used as a core and the core is coated with an insulating resin, and a toner in which polyester is used as a main material and a coloring agent such as a pigment or carbon black, a charge control agent, an external additive such as silica and titanium oxide are added. The carrier has a particle size of 15 to 100 μm, and a saturation magnetization of 10 to 80 emu/g, and the toner has a particle size of 3 to 15 μm, the charging characteristic of the toner is negative charging characteristic, and the average charge amount is −20 to −60 μC/g. A two-component developer obtained by mixing these carrier and toner so as to secure a toner concentration of 4 to 10% by mass is used.

The intermediate transfer belt 32 as an intermediate transfer member or an image carrier is rotatably stretched by a plurality of rollers including an opposing roller 321. For the intermediate transfer belt 32, for example, a semiconductor belt having a volume resistivity of 8 to 11 LOG Ω·cm with polyimide as a material and having a thickness of 80 μm is used. The plurality of rollers stretching the intermediate transfer belt 32 include the opposing roller 321 that forms a transfer nip together with a secondary transfer section to be described later. The opposing roller 321 is made of, for example, nitrile rubber (nitrile butadiene rubber (NBR)), and has a rubber hardness of 40° (Asker-C) and a volume resistivity of 8 LOG Ω.

The toner images formed by the respective image formers 31 are successively transferred to the surface of the intermediate transfer belt 32 by the respective primary transfer sections to be superimposed, and thereafter, transferred to a sheet S conveyed to a transfer position p1 (see FIG. 2 to be illustrated later). The secondary transfer section 34 comes in contact with the back side of the sheet at the transfer position p1 and transfers a toner to the front surface of the sheet. The sheet S to which the full-color toner image has been transferred is conveyed to the fixing device 36 on the downstream side to be heated and pressurized for forming a full-color image on the sheet S.

The transfer residual toner remaining on the intermediate transfer belt 32 without being transferred to the sheet S is conveyed to the downstream side and collected by the cleaning device 33 for the intermediate transfer belt 32. The cleaning device 33 includes a brush roller, a lubricant supply unit, one or more cleaning blades, and a casing that houses these components. The transfer residual toner on the intermediate transfer belt 32 is removed by the cleaning blade. A lubricant (lubricating agent) is applied to the surface of the intermediate transfer belt 32 by a lubricant supply unit.

The sheet feeding conveyance section 40 includes a plurality of sheet feeding trays 41 and sheet conveyance paths 42 and 43. A plurality of sheets S are stacked on the sheet feeding tray 41, and the uppermost sheets S are fed one by one. The sheet feeding conveyance section 40 includes a plurality of paired conveying rollers arranged along the sheet conveyance paths 42 and 43 and a driving motor (not shown) for driving the paired conveying rollers to convey the sheet S fed from the sheet feeding tray 41 to the transfer position of the secondary transfer section 34 or the fixing device 36 on the downstream side thereof.

When duplex printing is performed, the sheet S on which an image has been formed on one side is conveyed to the sheet conveyance path 43 for double-sided image forming on the lower side. The sheet S conveyed to the sheet conveyance path 43 is turned over by a switchback path and then joins again in the sheet conveyance path 42 for one side image forming, and again an image is formed on the other side of the sheet S in the image forming section 30.

Secondary Transfer Section 34

Figure 2:
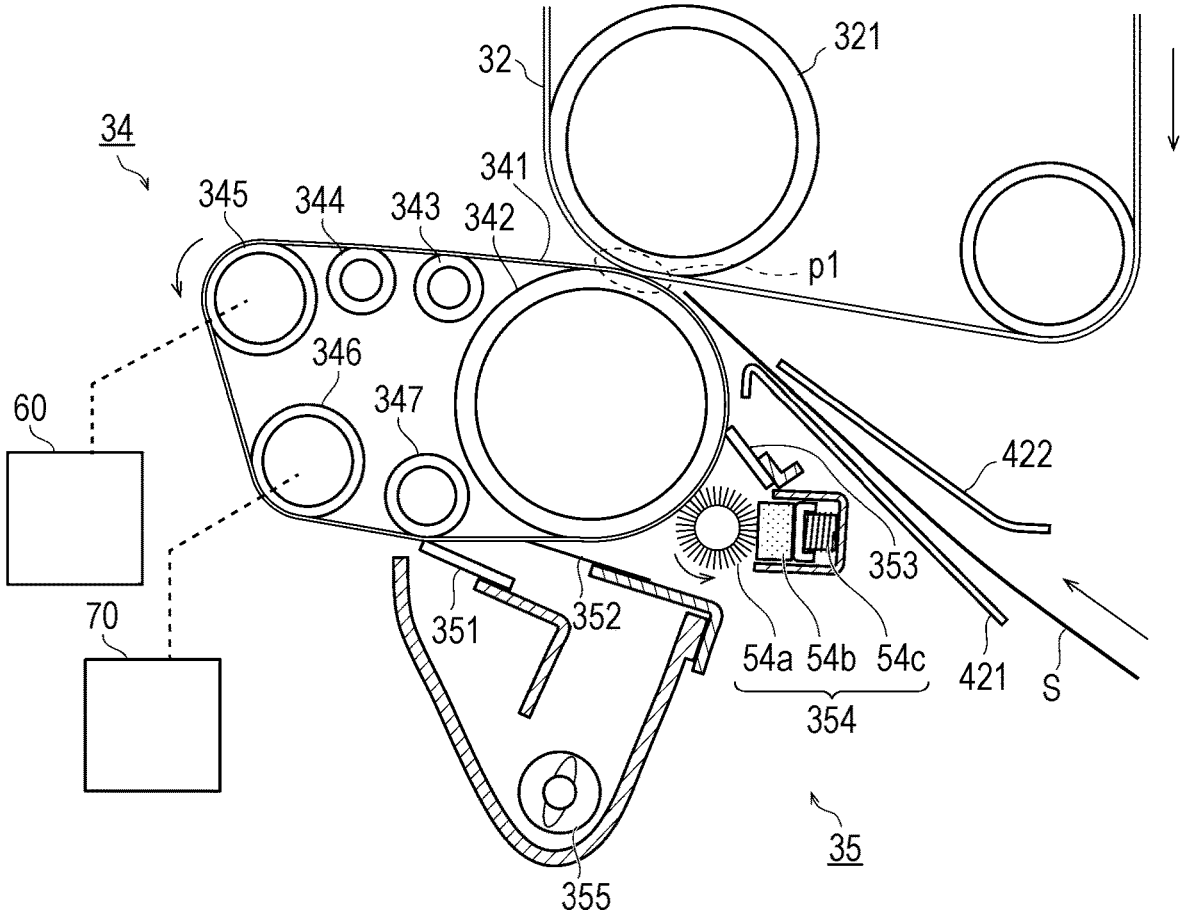
FIG. 2 is a diagram showing a configuration of a periphery of a secondary transfer section and a cleaning device.

FIG. 2 is an enlarged view of FIG. 1, showing the configuration of the periphery of the secondary transfer section 34 and the cleaning device 35. The secondary transfer section 34 and the cleaning device 35 are integrally replaceable as a secondary transfer unit. The secondary transfer section 34 has an endless secondary transfer belt 341 and a plurality of rollers 342 to 347 as transfer members.

The secondary transfer belt 341 functions as a "toner carrier". The secondary transfer belt 341 is rotatably stretched by the plurality of rollers 342 to 347, and moves in a counterclockwise direction (see the arrow) in the figure. As the secondary transfer belt 341, a resin belt made of polyimide, for example, having a volume resistivity of 10 LOG Ω·cm and a thickness of 100 μm is used.

The roller 342 functions as a secondary transfer roller. The roller 342 is pressed against the opposing roller 321 disposed on the inner peripheral surface side of the intermediate transfer belt 32 at a predetermined pressure, for example, 70 N. The intermediate transfer belt 32 and the secondary transfer belt 341 are sandwiched between the roller 342 and the opposing roller 321 to form a transfer nip at the transfer position p1. Further, at the time of transfer to the sheet S, a predetermined voltage or current is applied to the roller 342 by a high voltage power supply (not shown). The roller 342 is made of stainless steel (SUS). The roller 342 and the opposing roller 321 have substantially the same outer diameter, for example, both have an outer diameter of 30 mm.

The roller 345 functions as a driving roller and is driven by a driving unit 60 including a stepping motor, a gear, and the like. The roller 346 functions as a steering roller and is connected to a steering mechanism 70. The steering mechanism 70 has a drive source, an actuator, and a detection sensor. The steering mechanism 70 shifts (tilts) the position of at least one end of the roller 346 according to the end position of the secondary transfer belt 341 detected by the detection sensor. The steering mechanism 70 controls the movement of the secondary transfer belt 341 to prevent its meandering by inclining the rotation axis of the roller 346 with respect to the rotation axes of the other rollers 342 and 345 and the like.

Cleaning Device 35

The cleaning device 35 has a first blade 351, a second blade 352, a third blade 353 for pressing, a lubricant applicator 354, and a conveyance screw 355, and cleans the surface of the secondary transfer belt 341.

As shown in FIG. 2, the blade 351, blade 352, lubricant applicator 354, and blade 353 are disposed so as to be in contact with the surface of the secondary transfer belt 341, in this order from the upstream side in the direction of movement of the secondary transfer belt 341 on the basis of the transfer position p1.

Further, the blade 351 is disposed further downstream than the roller 346 disposed on the downstream side of the transfer position p1 for fulfilling a steering function. To be more specific, the second blade 352 is not disposed immediately on the downstream side of the roller 346 serving as the steering function. The reason for this is to prevent the following troubles in advance from occurring. As will be described later, there is no opposing roller at the contact position of the blade 352. That is, the blade 352 is configured to be in contact with only the secondary transfer belt 341. Therefore, if the roller 346 for steering is located immediately upstream, flapping occurs when meandering of the secondary transfer belt 341 occurs, which causes troubles such as slipping-through of toner and the like.

The first blade 351 is made of a rubber material. As the rubber material, urethane rubber is preferably used, but fluororubber, styrene butadiene rubber, or nitrile rubber may be applied. For example, the blade 351 has a thickness of 2 mm and is held by a holder so as to be in contact with the secondary transfer belt 341 at a contact angle of 15° and a contact pressure of 30 N/m (for example, a fixed type). The free length from the holder is 9 mm. A roller 347 functioning as an opposing roller is disposed inside the secondary transfer belt 341 so as to face the contact position of the blade 351. The roller 347 is made of a metal such as SUS, for example, and has an outer diameter of 12 mm The second blade 352 is made of a material harder than the blade 351. The blade 352 is a rigid body preferably made of a metal or a resin having high hardness such as a polycarbonate resin (PC), a polyacetal resin (POM), an ABS resin or the like, and more preferably a rigid body composed of SUS (particularly SUS304). For example, the blade 352 has a thickness of 0.1 mm and is held by a holder so as to be in contact with the secondary transfer belt 341 at a contact angle of 10° and a contact pressure of 5 N/m, and the designed intrusion amount is 0.3 mm (for example, a fixed type). The free length from the holder is 10 mm. Further, when the blade 352 is made of SUS material, it is preferable to provide a hard coating layer at least in the leading edge region (contact region). As a hard coating layer, there is a BCN type hard film, and in particular, a diamond like carbon (DLC) film is preferable. By providing such a hard coating layer at the leading edge of the blade 352, abrasion of the tip of the blade 352 can be suppressed, and stably durable cleaning performance can be secured.

Also, there is no opposing roller at the contact position of the blade 352. In other words, the contact position of the blade 352 is located in a region where no roller is disposed inside the secondary transfer belt 341. By doing in this way, when the contact pressure between the secondary transfer belt 341 and the hard blade 352 suddenly increases excessively, the secondary transfer belt 341 retreats inward (pushed up). As a result, the secondary transfer belt 341 can be prevented from being broken or scratched on the surface. Further, if a roller is disposed inside the contact position of the blade 352 of the secondary transfer belt 341, when foreign matter adheres to the roller or the back surface of the secondary transfer belt 341, the secondary transfer belt 341 swells on the roller. At this time, the hard blade 352 cannot absorb the swelling, and the problem that the toner slips through both sides of the swelling portion occurs. Such a problem can be prevented in advance by adopting the structure as in this embodiment.

The third blade 353 is a blade for fixing which levels and presses the lubricant supplied onto the secondary transfer belt 341 from the lubricant applicator 354 to be described later. As shown in FIG. 2, the first and second blades 351 and 352 are in contact with the secondary transfer belt 341 in a counter manner in which their tips are directed to the upstream side in the moving direction of the secondary transfer belt 341. On the other hand, the third blade 353 is held by the holder so that the tip of the third blade 353 is in contact in a trail manner in which the tip thereof is directed to the downstream side. The third blade 353, for example, has a thickness of 1.6 mm and is in contact with the secondary transfer belt 341 at a contact angle of 51°. The amount of intrusion in design is 0.3 mm. The free length from the holder is 6 mm.

The lubricant applicator 354 has a brush roller **54*a*, solid lubricant 54*b*, and support portion 54*c*. One end of the support portion 54*c* is fixed to the housing. The solid lubricant 54*b* is formed by solidifying powder of the molten lubricant into a substantially rectangular parallelepiped shape, and has a height of 4.5 mm, and a depth and a width of 8 mm, for example. As the lubricant used for the solid lubricant 54*b*, a material is selected which can be applied onto the surface of the secondary transfer belt 341 and lower the surface energy to reduce the adhesion force between the attached matter such as toner and the secondary transfer belt 341**. For example, as the lubricant, fatty acid metal salt, fluorine resin and the like can be cited, and these materials can be used alone or in combination of two or more kinds. In particular, fatty acid metal salt is preferred. For the fatty acid metal salt, straight chain hydrocarbon is preferable as the fatty acid, and for example, myristic acid, palmitic acid, stearic acid, oleic acid and the like are preferable, and stearic acid is more preferable. Examples of metals include lithium, magnesium, calcium, strontium, zinc, cadmium, aluminum, cerium, titanium, iron and the like. Of these materials, zinc stearate, magnesium stearate, aluminum stearate, iron stearate and the like are preferable, and zinc stearate is the most preferable.

The support portion **54*c* is composed of a holder for holding the solid lubricant 54*b* and an elastic body such as a coil spring, and presses (brings) the solid lubricant 54*b* against (into contact with) the brush roller 54*a* with a predetermined pressing force via the holder. The intrusion amount of the brush roller 54*a* into the secondary transfer belt 341 is 0.5 mm for example, and the pressing force at this time is 1 N. The brush roller 54*a* is one in which brush fibers are implanted or wound around a core metal having an outer diameter of 6 mm, and the overall outer diameter is 12 mm. This brush fiber is made of a polyester material having a pile diameter of 4 d and a pile density of 150 KF/inch$^2$, for example, and the resistance is on the order of $10^{12}\Omega$. The brush roller 54*a* is rotationally driven in the counter direction with respect to the moving direction of the secondary transfer belt 341 by a driving unit (not shown). By the rotational drive, the brush roller 54*a* scrapes the lubricant (lubricant powder) from the solid lubricant 54*b* and applies the lubricant to the surface of the secondary transfer belt 341**.

The toner, external additives and the like scraped off from the secondary transfer belt 341 by the blades 351 and 352 fall downward along the inner surface of the casing covering the blades 351 and 352. The conveyance screw 355 is provided at the bottom of the casing, and the dropped toner and the like are conveyed to the back surface side of the apparatus main body by the conveyance screw 355, and collected in the collection box arranged on the back surface side.

Effect of the Present Embodiment

Figure 3:
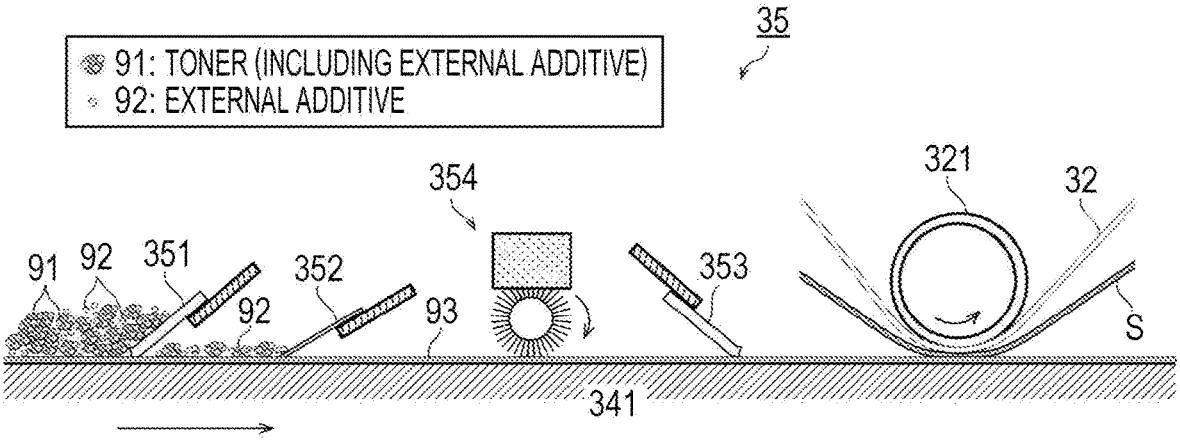
FIG. 3 is a diagram schematically showing a configuration of the cleaning device according to an embodiment of the present embodiment.
Figure 4:
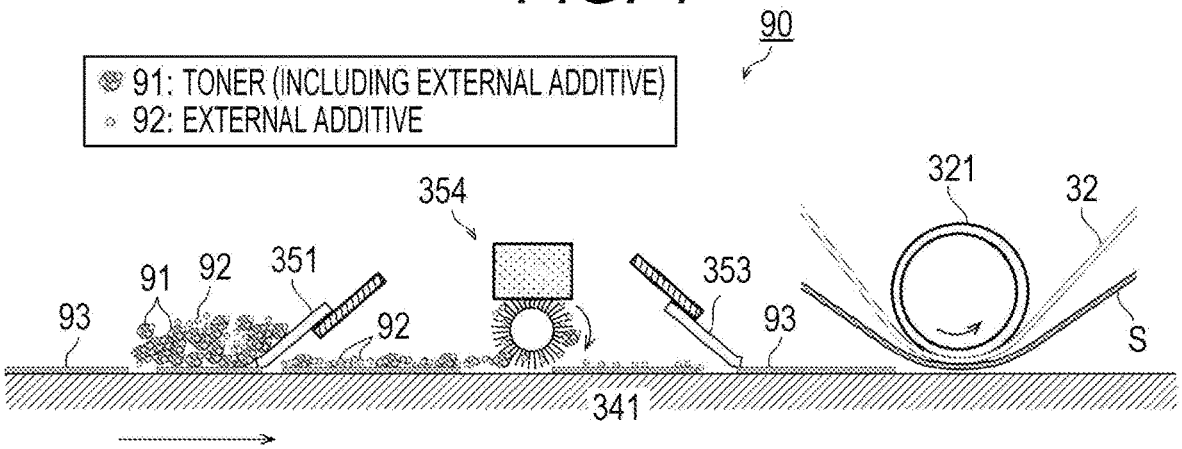
FIG. 4 is a diagram schematically showing a configuration of a cleaning device according to a comparative example.

In the present embodiment, the second blade 352 made of a harder material than the first blade 351 is disposed immediately downstream side of the first blade 351, as described above. This effect will be described below with reference to FIGS. 3 and 4. FIG. 3 is a diagram schematically showing the configuration of the cleaning device 35 according to the present embodiment. FIG. 4 is a diagram schematically showing the configuration of a cleaning device 90 according to a comparative example. In the cleaning device 90, the second blade 352 is not provided. Even in the system in which the lubricant is applied, the wear of the blade 351 made of urethane rubber progresses as the blade is used. As the wear of the blade progresses, the (local) surface pressure at the edge of the blade reduces and a toner 91 and an external additive 92 easily pass through. The external additive 92 has been added to the surface of the toner 91 but is removed and separated from the surface by stress or the like caused by mixing and stirring with the carrier.

In the comparative example shown in FIG. 4, when such a worn blade 351 is used, the toner 91 and the external additive 92 (hereinafter simply referred to as toner and the like) which have slipped through the blade 351 reach the lubricant applicator 354 on the downstream side. When the toner and the like having reached adheres to and contaminates the surface of the brush roller 54*a*, scraping of the lubricant from the solid lubricant 54*b* and application to the secondary transfer belt 341 cannot be performed normally at this portion. As a result, the surface of the secondary transfer belt 341 has coating unevenness which creates a portion where a lubricant layer 93 is not formed. When there is coating unevenness of the lubricant, the unevenness appears as a streak in the image, and the image becomes defective depending on the level. Further, the toner and the like having slipped through the blade 351 also reaches the third blade 353 on the downstream side of the lubricant applicator 354. The toner and the like can be scraped to some extent by the blade 353 in contact with the belt in the trail manner, but the cleaning ability is not high. Therefore, the toner and the like cannot be completely removed, and a part thereof passes through the blade 353, reaches the transfer position, and contaminates the sheet S, resulting in image defect. In the case of duplex printing, as the sheet S passes through the fixing device 36, wax adheres to the surface thereof. This wax is for improving the releasability of the fixing roller constituting the fixing device 36, and is applied to the surface of the fixing roller with a web or the like containing oil, for example. By conveying the sheet S for transferring, wax may adhere to the surface of the secondary transfer belt 341 in some cases. In such a case, due to the viscosity of the wax, the toner 91 and the external additive 92 tend to aggregate easily, and there is also a problem that the aggregated toner 91 and external additive 92 are transferred to the sheet S again so that image contamination easily becomes apparent.

On the other hand, in the present embodiment, the hard blade 352 is provided between the rubber blade 351 and the lubricant applicator 354, as shown in FIG. 3. With such a configuration, even at the end of endurance period, most of the toner 91 and the external additive 92 are removed by the blade 351, and a small amount of the toner, external additive, and wax (hereinafter simply referred to as a toner and the like, including wax) having slipped through the blade is sufficiently removed with the hard blade 352. By doing in this manner, contamination by the toner and the like of the lubricant applicator 354 can be prevented so that the application performance of the lubricant applicator 354 can be maintained for a long period of time. Further, it is possible to prevent the toner and the like from reaching the blade 353 on the further downstream side. Consequently, in the cleaning device according to the present embodiment and the image forming apparatus including the cleaning device, image defects of the sheet S can be prevented stably over a long period of time, so that a period (maintenance cycle, endurable number of sheets) until occurrence of a defective image can be lengthened, and the durability can be improved.

Length in Width Direction

Figure 5A:
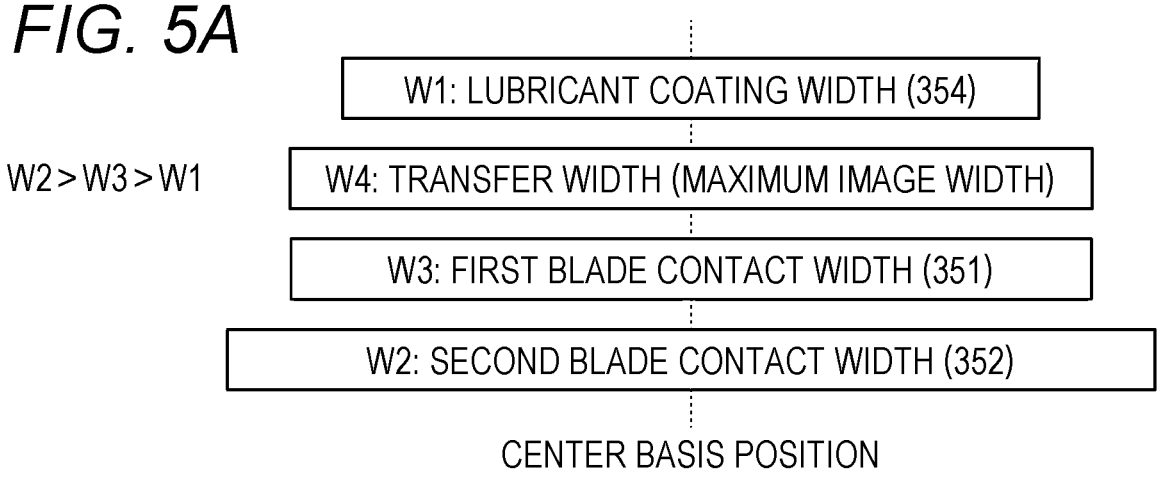
FIGS. 5A to 5C are schematic views for illustrating positional relationships in the width direction of respective component members.
Figure 5B:
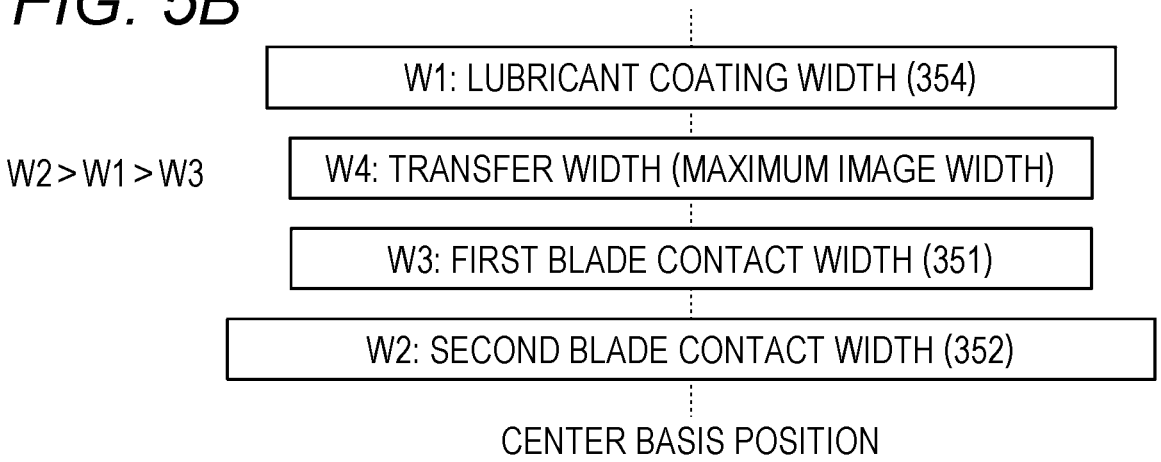
Figure 5C:
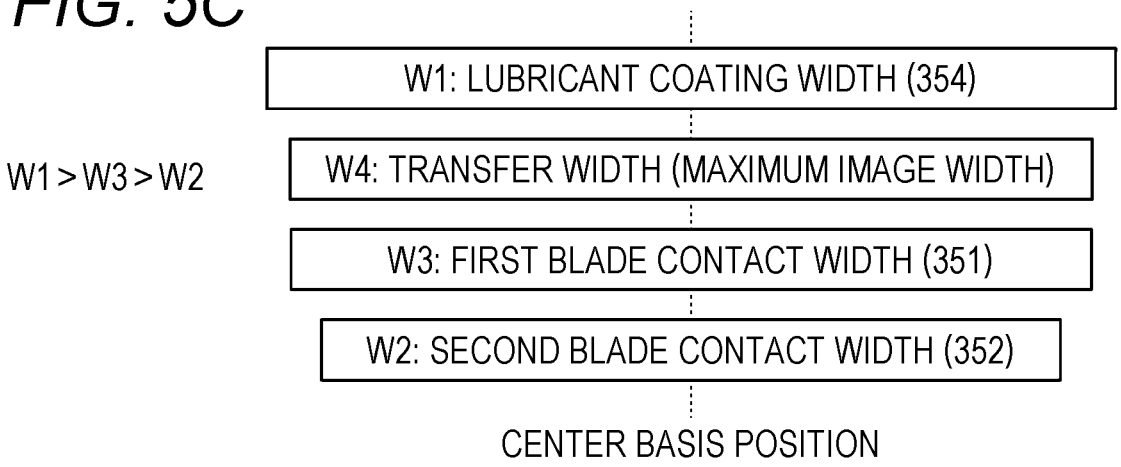

FIGS. 5A to 5C are schematic diagrams for illustrating the positional relationship of component members in the width direction perpendicular to the moving direction of the secondary transfer belt 341. FIG. 5A shows the positional relationship of components in Example 1, FIG. 5B shows the positional relationship in Example 2, and FIG. 5C shows the positional relationship in a comparative example. In each figure, the coating width W1 of the lubricant applied by the lubricant applicator 354, the transfer width (maximum image width) W4, the contact width W3 of the blade 351, and the contact width W2 of the blade 352 are shown in this order from the top.

In the present embodiment, the constituent members shown in FIGS. 5A to 5C are aligned on the basis of each center position. In addition, the position in the width direction of the sheet housed in the sheet feeding tray 41 and the image formation width (exposure width, development width, transfer width) are also aligned on the basis of each center position similarly.

In the arrangement position of the comparative example of FIG. 5C, the coating width W1 is greater than the contact width W2. For this reason, toner and the like having passed through the sides of the blade 352 are carried to the lubricant applicator 354 so that coating unevenness may occur on the end sides. Further, since the contact width W3 is greater than the contact width W2, toner and the like having slipped through the blade 351 cannot be removed by the blade 352 on the end sides, and thus the toner and the like having passed through the sides of the blade 352 are carried to the lubricant applicator 354 so that coating unevenness may occur.

In Examples 1 and 2 of FIGS. 5A and 5B, since the contact width W2 is greater than the coating width W1, the above-described problem does not occur. Further, since the contact width W2 is greater than the contact width W3, the toner and the like having passed through the blade 351 can be removed by the blade 352. However, since the coating width W1 is greater than the contact width W3 in Example 2, the lubricant applied by the lubricant applicator 354 directly reaches the blade 352. The size of the lubricant applied by the lubricant applicator 354 varies, and when the large-diameter lubricant directly reaches the blade 352, the surface of the secondary transfer belt 341 may be scratched. In addition, when the large-diameter lubricant is pinched between the blade 352 and the secondary transfer belt 341, the secondary transfer belt 341 is pushed away and there is a possibility that the slipping-through may occur.

For this reason, the relationship of the contact width W2> the contact width W3> the coating width W1 is more preferably satisfied as in Example 1. In this case, the above problem does not arise.

The purpose of the description given above concerning the configurations of the cleaning device 35 and the image forming apparatus 1 is to describe the main configuration for description of the features of the above embodiment, and thus the present invention is not limited to the above configuration, and various changes can be made within the scope of the claims. Further, the present invention does not exclude a general cleaning device or a configuration of an image forming apparatus. For example, in the configuration described above, the example in which the present invention is applied to the cleaning device 35 for the secondary transfer belt has been described, but the present invention may be applied to the cleaning device 33 for the intermediate transfer belt 32. In addition, as the toner carrier, a toner carrier in which an elastic surface layer is formed on a drum-shaped rigid body may be used, instead of an endless belt such as a secondary transfer belt or an intermediate transfer belt.

Although embodiments of the present invention have been described and illustrated in detail, the disclosed embodiments are made for purposes of illustration and example only and not limitation. The scope of the present invention should be interpreted by terms of the appended claims.

What is claimed is:

1. A cleaning device for cleaning a surface of a toner carrier carrying a toner, the cleaning device comprising:

a first blade in contact with the surface of the toner carrier;

a second blade made of a material harder than a material of the first blade and in contact with the surface of the toner carrier; and a lubricant applicator that applies a lubricant to the surface of the toner carrier, wherein the first blade, the second blade and the lubricant applicator are arranged upstream of a transfer position of the toner in this order in a moving direction of the toner carrier, the toner carrier is an endless belt stretched around a plurality of rollers, and a contact position of the second blade with the endless belt is provided in a region where no rollers are disposed inside the endless belt.

2. The cleaning device according to claim 1, wherein the second blade is a rigid body.

3. The cleaning device according to claim 1, wherein the material of the second blade is a metal.

4. The cleaning device according to claim 1, further comprising a coating layer at least in a contact region with the toner carrier on a surface of the second blade.

5. The cleaning device according to claim 4, wherein the coating layer is a diamond like carbon film.

6. The cleaning device according to claim 1, wherein the material of the first blade is rubber.

7. The cleaning device according to claim 1, wherein when a coating width of the lubricant applied by the lubricant applicator to the toner carrier is W1 and a contact width of the second blade is W2 in a width direction perpendicular to the moving direction of the toner carrier, a relationship of W2>W1 is satisfied.

8. The cleaning device according to claim 7, wherein when a contact width of the first blade with the toner carrier in the width direction is W3, a relationship of W2>W3>W1 is satisfied.

9. The cleaning device according to claim 1, further comprising a third blade that presses the lubricant against the toner carrier downstream of the lubricant applicator and upstream of the transfer position in the moving direction.

10. The cleaning device according to claim 1, wherein the toner carrier is a transfer member that comes in contact with a back side of a sheet to transfer a toner to a front surface of the sheet at the transfer position, or an intermediate transfer member with a surface to which a toner is transferred at the transfer position.

11. The cleaning device according to claim 1, wherein the plurality of rollers include a steering roller that is inclined by a steering mechanism to control a position of the endless belt in a width direction, and the first blade is disposed further downstream of the transfer position in the moving direction than the steering roller.

12. An image forming apparatus comprising:

an image former that develops a toner image on an image carrier;

a toner carrier that comes in contact with a back side of a sheet to transfer the toner image onto a front surface of the sheet at a transfer position or that has a surface to which the toner image is transferred at the transfer position; and the cleaning device according to claim 1 that cleans the surface of the toner carrier.

* * * * *